US006626713B2

(12) United States Patent
Bruce

(10) Patent No.: US 6,626,713 B2
(45) Date of Patent: Sep. 30, 2003

(54) WATER INTAKE AND TRANSMISSION SYSTEM

(75) Inventor: Harold Bruce, Cerritos, CA (US)

(73) Assignee: Dual Drive Systems, Inc., Anaheim, CA (US)

( * ) Notice: Subject to any disclaimer, the term of this patent is extended or adjusted under 35 U.S.C. 154(b) by 0 days.

(21) Appl. No.: 09/995,980

(22) Filed: Nov. 15, 2001

(65) Prior Publication Data

US 2003/0092330 A1 May 15, 2003

(51) Int. Cl.[7] ..... B63H 11/00
(52) U.S. Cl. ..... 440/38; 440/75; 440/80
(58) Field of Search ..... 440/38, 75, 80

(56) References Cited

U.S. PATENT DOCUMENTS 5,649,844 A * 7/1997 Caricof et al. ..... 440/75
5,800,222 A * 9/1998 Nanami ..... 440/38
5,967,864 A * 10/1999 Koyano et al. ..... 440/38
6,022,250 A * 2/2000 Futaki et al. ..... 440/38
6,287,162 B1 * 9/2001 Freitag et al. ..... 440/82
6,406,339 B1 * 6/2002 Sills ..... 440/38

* cited by examiner

*Primary Examiner*—Stephen Avila
(74) *Attorney, Agent, or Firm*—Stetina Brunda Garred & Brucker

(57) ABSTRACT

A water intake and transmission system for simultaneously driving dual jet units of a jet boat. According to a preferred embodiment, the water intake includes dual channels to allow the uptake of dedicated streams of water. Mounted to the intake is a housing having first and second jet units encased therein wherein each jet unit receives a dedicated stream of water from a respective channel of the water intake. A transmission is operatively coupled to each respective jet unit and is further connected to the driveshaft of the boat engine that is operative to simultaneously drive both jet units from a single driveshaft.

12 Claims, 2 Drawing Sheets

WATER INTAKE AND TRANSMISSION SYSTEM

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

Water pump-propelled boats or "jet boats" are well-known in the art. In this regard, such boats comprise a normal boat fitted with an engine to drive a water pump or "jet unit" which draws water from an intake formed in the bottom of the boat and thereafter discharges the water through the transom of the boat at a high velocity. To achieve that end, the jet unit typically is provided with an impeller and stator which increases the pressure of the water flow drawn in from the intake and discharges the same via a nozzle formed at the back of the jet unit as a high velocity jet stream. The jet unit is propelled by a jet-drive motor, which typically comprises a conventional motor having a driveshaft attached via a coupling formed upon the jet unit to turn the impeller.

The design features typically incorporated in most jet boats have several advantages over most other forms of marine propulsion, such as stern drives, outboard motors, shafted propellers and the like. Among such advantages include substantially greater safety insofar as water jet propulsion does not incorporate the use of an exposed propellers, which are known to cause substantial injury. Additionally, the lack of exposed propeller eliminates impact damage or snags that can occur with protruding propulsion gear, as well as substantially reduces hull resistance insofar as the jet intake is generally flush with the hull bottom. Jet boats further typically provide a greater degree of a maneuverability and steering control than boats propelled by other means, especially outboard motors. Moreover, jet boats are widely considered to be highly efficient, operate smooth and quietly, and able to maximize engine life insofar as engine overload utilizing water jet propulsion is nearly impossible.

Despite such advantages, however, substantial drawbacks still exist with respect to the design of most jet units incorporated within most jet boats. In this regard, virtually all water jet systems incorporate the use of a single jet unit driven by a single engine. In such arrangement, the performance of the boat is limited by the jet unit generating the water jet propulsion. Unfortunately, a single water jet is limited in its capacity to generate a high velocity jet stream of water despite the fact that the most jet boat engines have more than sufficient horse power to drive the jet unit to its maximum capacity. Indeed, such drawbacks continue to exist despite substantial advances that have been made in jet unit design.

As a consequence, virtually all jet boats currently in use, despite the engine capacity to do so, suffer from suboptimal fuel efficiency, slower acceleration, lesser responsiveness, and lesser ability to pull heavier loads than could be attained if the water jet propulsion generated by the jet unit were commensurate with engine capacity. Such, despite its potential to be the most advantageous form of marine propulsion, water jet propulsion is deemed only the equivalent or at best only slightly more advantageous than other forms of propulsion, and in particular outboard propeller systems and the like.

Accordingly, there is a substantial need in the art for a system by which jet stream velocity and intensity can be maximized in a water jet propulsion system to thus enable a jet boat to exhibit faster speeds, greater performance, enhanced fuel efficiency, and the ability to pull heavier loads, especially at lower engine RPM's. There is additionally a need for such a system whereby the water intake and discharge can be maximized in a water jet propulsion system that is substantially greater than prior art systems and methods. Still further, there is a need in the art for such a system that is relatively inexpensive, can be readily incorporated into the production of new boats, can be configured as a retrofit for installation for existing boats, and can be constructed utilizing conventional water jet propulsion componentry.

BRIEF SUMMARY OF THE INVENTION

The present invention specifically addresses and alleviates the above-identified deficiencies in the art. In this regard, the present invention is directed to a water intake and transmission system that enables two or more water pumps or jet units to be simultaneously driven by a single engine to thus substantially enhance the velocity and propulsive thrust of a jet stream generated thereby. According to a preferred embodiment, the invention comprises a water intake system comprised of a dual-channel channel intake defining first and second intake channels. A housing encasing two side-by-side jet units is coupled to the water intake such that a first jet unit is operative to receive water from a respective one of the intake channels, and the second jet unit is operative to receive water from the respective other intake channel. A transmission system is operatively coupled to both jet units and the driveshaft of the boat engine and is operative to simultaneously drive both jet units from a single driveshaft. Preferably, such transmission system incorporates the use of gears to simultaneously drive both jet units, but other configurations such as belt drives and the like, are also contemplated.

The water intake and transmission system can be readily incorporated into the construction of new boats, as well as installed as a retrofit into existing boats. In this respect, the water intake need only be installed in place of an existing water intake with the housing having dual jet units mounted thereon coupled to such water intake. The driveshaft is operatively connected to the transmission system to thus enable both jet units to be simultaneously driven thereby.

BRIEF DESCRIPTION OF THE DRAWINGS

These as well as other features of the present invention will become more apparent upon reference to the drawings wherein.

DETAILED DESCRIPTION OF THE INVENTION

Figure 1:
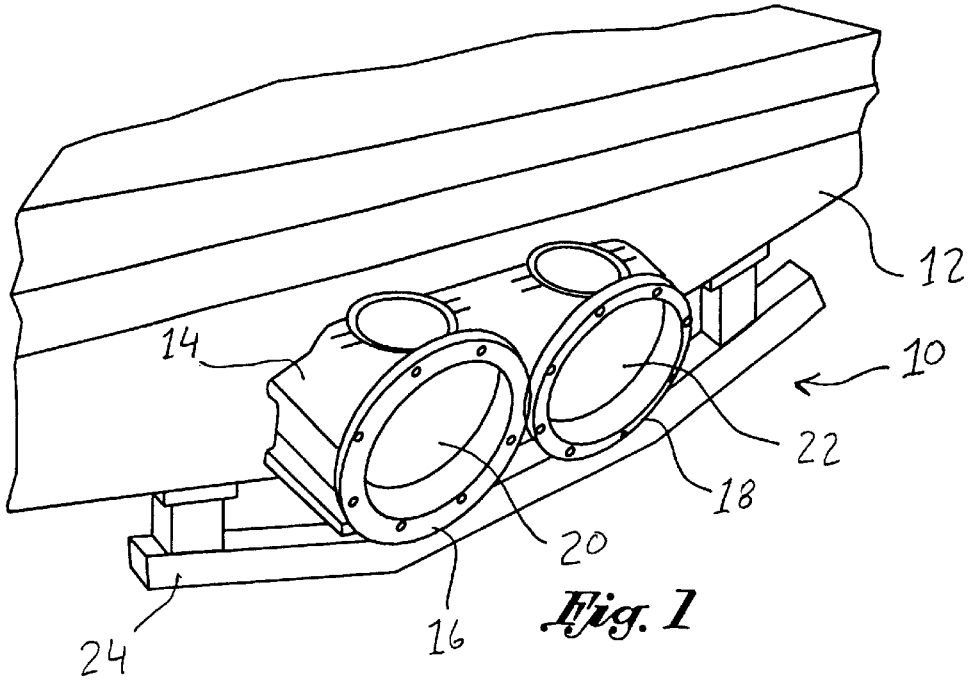
FIG. 1 is a partial perspective view of a transom of a boat depicting two respective outputs of two jet units.

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Referring now to the figures, and initially to FIG. 1, there is shown a dual nozzle water jet propulsion system 10 as provided by a novel water intake and transmission constructed in accordance with the preferred embodiment of the present invention, discussed below. As illustrated, the dual jet unit outputs are characterized by first and second output nozzles 16, 18 emanating from a housing 14, the latter mounted upon the transom 12 of the boat. For purposes of illustration, the transom 12 is shown supported by boat support 24. As will be appreciated by those skilled in the art, each respective nozzle 16, 18 is operative to discharge a high velocity jet stream of water via apertures 20, 22, respectively, which thus provide the boat with a propulsive thrust. At the outset, it should be readily appreciated that virtually all jet boats and the like are incapable of supporting dual jet units, and thus have been limited by the performance and power of a single jet unit. The present invention specifically addresses such shortcomings associated with such prior art limitations.

Figure 2:
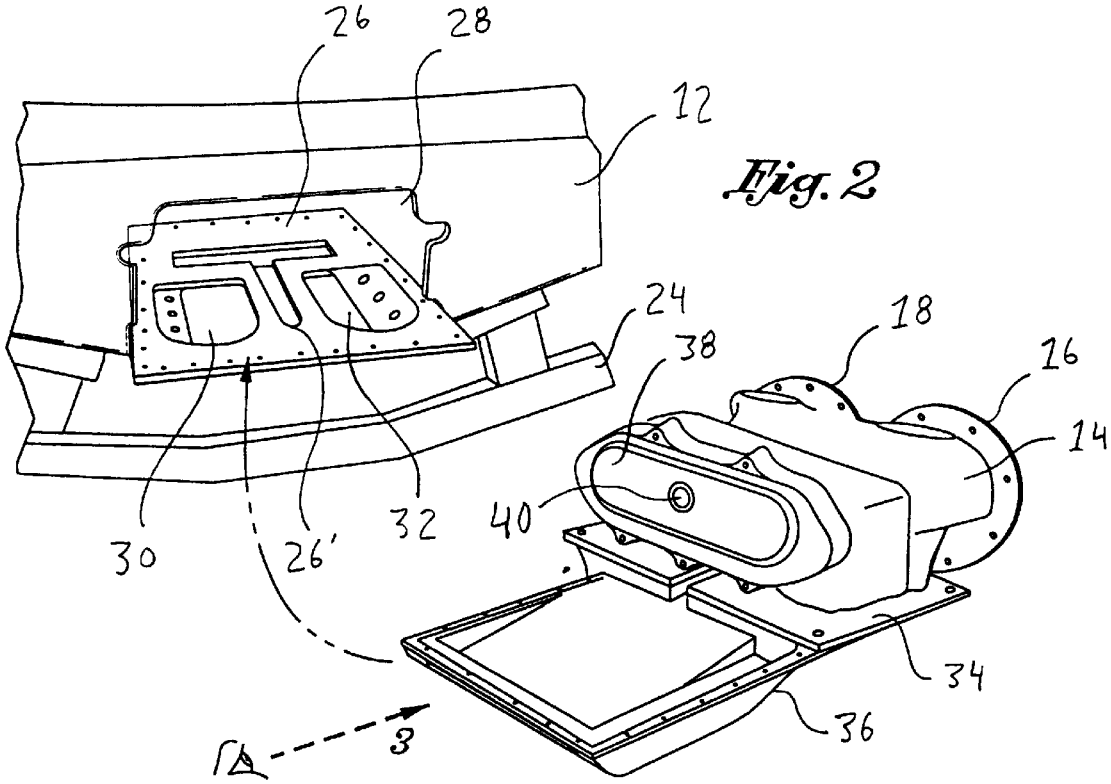
FIG. 2 is a perspective view of a water intake integrated into the hull of a boat and a dual jet unit drive to be operatively coupled therewith, the latter including a housing encasing side-by-side jet units, an intake cover and a transmission system, coupled therewith each constructed in accordance to a preferred embodiment of the present invention operatively coupled therewith showing a plurality of gears therewith in phantom.

Referring now to FIG. 2, there are shown the operative components for constructing and simultaneously operating the dual jet unit depicted in FIG. 1. Formed upon the bottom of the boat and bottom-most portion of the transom is a water intake 26 having first and second intake channels 30, 32 formed thereon. Such intake 26 is specifically designed and configured to be mounted upon the boat as per conventional water intake mechanisms currently in use and well-known in the art. Along these lines, such intakes are typically characterized as shallow intake slots from which water is drawn into a jet unit and, ultimately, accelerated through the jet unit and discharged through the transom at high velocity.

The intake 26 of the present invention differs in this respect insofar as the same provides for two separate dedicated channels 30, 32 which, as discussed below, define two separate intake feeds to two separate jet units. To define such separate channels, intake 26 includes an intermediate bar portion 26'. As will be readily appreciated by those skilled in the art, channels 30, 32 may take any of a variety of designs provided, however, that the same are capable of facilitating water uptake into two separate channels and, further, preferably are flush with the hull bottom to afford minimum draught.

Shown disconnected from intake 26 is a transmission/jet unit housing comprised of housing 14, transmission system 38 and water intake cover 36. As illustrated, the housing 14 is securely fastened to intake cover 36 via a base plate 34 that is securably bolted thereto. The intake cover 36 is designed to be mounted upon intake 26 as indicated by the arrows of FIG. 2. The housing 14 is operative to encase two conventional water jet units such that the same are positioned side-by-side. As will be recognized by one of ordinary skill, such jet units may take any of a variety of forms well-known in the art, such as those produced by Hamilton Jet, Inc. of Seattle, Wash. and Doen Marine Pty. Ltd., of Australia. In this regard, such water jet units, as discussed above, are extensively utilized throughout the world, well-known and readily available commercially.

Operatively connected to the housing 14, as well as each respective jet unit disposed therein, is transmission unit 38.

The transmission unit 38, although not shown, is operatively coupled to each respective jet unit via a coupling that enables the same to drive each respective impeller thereof, discussed more fully below. Formed upon the outside casing of the transmission unit 38 is driveshaft coupling 40, the latter being operative to interconnect with the driveshaft of the boat engine, not shown. In this respect, the jet engine and driveshaft for use in the practice of the present invention may take any of those well-known in the art that have been and continue to be commercially available. Coupling 40 merely comprises a conventional mechanical arrangement by which the driveshaft may be affixed thereto.

Figure 3:
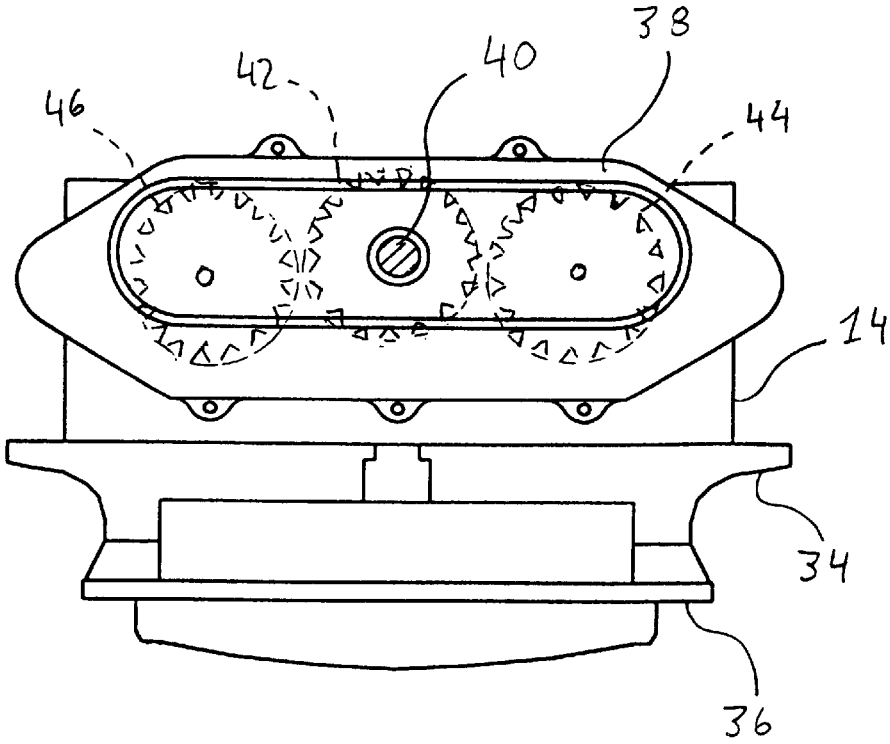
FIG. 3 is a frontal view of the transmission system and housing formed about the dual jet units.

Referring now to FIG. 3, there is shown the transmission system 38 by which both jet units contained within housing 14 are simultaneously operated. As illustrated, transmission system 38 includes a metal casing to preferably house a plurality of gears shown in phantom which include, at a minimum, central gear 42 and side gears 44, 46. As will be readily appreciated by those skilled in the art, central gear 42, which will be driven by the driveshaft connected to driveshaft coupling 40, will be operative to simultaneously drive both side gears 44, 46, the latter operatively coupled to impellers within the respective jet units. Although not shown, it is further contemplated that idle gears may be provided to enable the transmission system to operate in an idle mode, as may be desired.

Advantageously, by virtue of simultaneously operating both side-by-side jet units, the present invention is thus able to virtually double the output and power of most jet boats currently in use by simply operating two jet units from one driveshaft operated by one engine. As is well-known in the art, jet boats, despite numerous advantages, still suffer the drawbacks of fuel inefficiency, lack of power, plus several others. Such drawbacks, however, have not been attributable to boat engines, which typically have more than enough power to drive the jet unit. The present invention solves such deficiencies by enabling multiple jet units to be driven safely and easily from a single jet engine.

As will be readily appreciated by those skilled in the art, although the gear system 38 depicted incorporates the use of gears 42, 44, 46, a wide variety of other transmission schemes and mechanisms can be deployed which are operative to produce the same effect whereby multiple jet units, in this case side-by-side jet units, are simultaneously driven by a single driveshaft of an engine. For example, it is contemplated that such transmission system may incorporate the use of belt drives, or the combination of belt drives and gears. It is further contemplated that multiple driveshafts may be incorporated to thus simultaneously drive the jet units from a single unit driveshaft. Accordingly, the transmission system 38 should be construed as broadly as possible to encompass such well-known and recognized variations.

Figure 4:
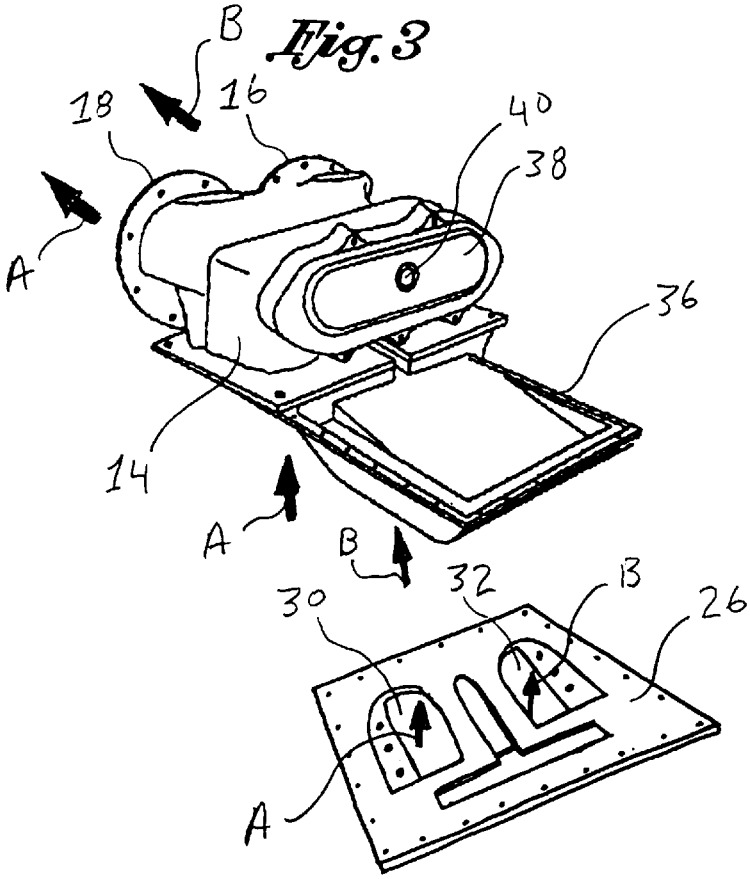
FIG. 4 is an exploded view of the water intake of FIG. 2 with housing and transmission system of FIG. 2 depicting water flow therethrough.

Referring now to FIG. 4, there is shown an angled exploded view of the water intake 26 and housing 14 with transmission system 38 and intake cover 36 for use in cooperatively generating water jet. In this respect, the arrangement between intake 26, intake cover 36 and housing 14 with jet units stored therein are operatively connected such that water is taken in by the intake and, ultimately, discharged via each respective nozzle 16, 18 to thus provide a propulsive jet stream. More specifically, intake 26 is operative to provide first and second intake streams of water A, B, that are respectively generated through water flowing through channels 30, 32. Each respective water intake stream A, B, is then drawn into the respective water jet units via the impellers incorporated within each respective jet unit, as encased by housing 14. The impeller and stator of each respective jet unit increases the pressure of each respective stream of water A, B, and cause the same to be discharged as two separate high velocity jet streams via nozzles 16, 18, as shown. Advantageously, because each respective impeller of each jet unit is driven from a single driveshaft coupled at 40, both jet units will simultaneously accelerate, decelerate, or otherwise respond in a simultaneous manner, which thus prevents independent operation of the jet units.

As a result of the ability of the intake and transmission system to simultaneous to feed and operate two jet units, there is substantially increase the speed and acceleration of the jet boat, as well as the power of the jet boat. The latter aspect is particularly advantageous when using such boats for towing applications and the like. Such intake transmission system further enables jet boats to provide the same if not substantially more power and maneuverability than other marine propulsion systems, such as outboard propeller driven systems, and the like, but without the substantial disadvantages associated with such systems, such as the use of propellers or other under water appendages. Other advantages will be readily apparent to those skilled in the art.

Additional modifications and improvements of the present invention may also be apparent to those of ordinary skill in the art. For example, although depicted as incorporated in the use of two side-by-side jet units, it will be readily apparent to those skilled in the art that multiple jet units (i.e., three or more) may also be readily deployed utilizing the concepts of the prior invention. In such applications, it would be recognized that the water intake 26 will be modified to accommodate one or more additional intake streams and that the transmission system 38 will be operative to transmit an additional driving force (i.e., capable of driving an additional impeller) of any such additional jet units that maybe incorporated. Additionally, the transmission system 38 may be modified to enable only one jet unit to operate to the extent a lesser degree of thrust is desired. Thus, the particular combination of parts and steps described and illustrated herein is intended to represent only certain embodiments of the present invention, and is not intended to serve as limitations of alternative devices and methods within the spirit and scope of the invention.

What is claimed is:

1. A system for simultaneously generating two jet streams from two respective jet units from a single engine-driven driveshaft to provide a propulsive thrust for a jet boat comprising:

a) a water intake attachable to the hull of said jet boat, said intake having a first channel formed therein for delivering water to a respective one of said jet units, and a second channel for delivering water to a respective other of said jet units;

b) a transmission system operatively coupled to the drive shaft of the engine of said jet boat, said transmission system being operatively coupled directly to respective ones of the impellers of said jet units such that said jet units are simultaneously driven by the driveshaft of said engine, said transmission comprising:

i) a central gear member having a coupling formed thereon for connecting with said drive shaft;

ii) a first side gear selectively engageable with said central gear member, said first gear member being operatively coupled directly to an impeller of a respective one of said jet units; and iii) a second side gear selectively engageable with said central gear member, said second gear being operably coupled directly to the respective other impeller of said jet units.

2. The device of claim 1 wherein said transmission system comprises at least one central gear member operatively coupled to said driveshaft and at least one side gear for selectively engaging with said central gear for driving the impeller of a respective one of said jet units, and at least one second gear selectively engageable with said central gear for driving the impeller of said second jet unit.

3. The device of claim 1 wherein said device further comprises:

a) a housing positionable about said jet units for forming an encasement thereabout.

4. The device of claim 3 further comprising a water intake cover attached to said housing and positionable over said water intake, said intake cover being operative to facilitate the uptake of water through said intake and into said jet units, respectively.

5. The device of claim 1 wherein said channels of said intake are formed in a side-by-side configuration.

6. The device of claim 1 wherein said system is formed as a retrofit for installation into an existing boat.

7. The system of claim 1 wherein said transmission of said system comprises at least one belt drive extending from said central gear member to at least one side gear.

8. The system of claim 7 wherein said transmission further includes a first dedicated belt drive extending from said central gear member to said first side gear and a second belt drive extending from said central gear member to said second side gear.

9. A transmission system for simultaneously generating two jet streams from two respective jet units from a single-engine driven drive shaft to provide a propulsive thrust for a jet boat comprising:

a) a central gear member having a coupling formed thereon for connecting with said drive shaft;

b) a first side gear selectively engageable with said central gear member, said first gear member being operatively coupled directly to an impeller of a respective one of said jet units;

c) a second side gear selectively engageable with said central gear member, said second gear being operably coupled directly to the respective other impeller of said jet units; and d) a housing formed about and encasing said first central gear, said first gear, and said second gear.

10. The transmission system of claim 9 wherein said each respective one of said jet units are conventional jet boat units.

11. The transmission system of claim 9 wherein said transmission comprises at least one belt drive extending from said central gear member to at least one side gear.

12. The transmission system of claim 11 wherein said transmission further includes a first dedicated belt drive extending from said central gear member to said first side gear and a second belt drive extending from said central gear member to said second side gear.

* * * * *